US005836369A

United States Patent [19]

Renner et al.

[11] Patent Number: 5,836,369

[45] Date of Patent: Nov. 17, 1998

[54] PROCESS FOR RECLAIMING USED FOUNDRY SAND

[75] Inventors: Christian Renner, Beringen; Jovo Laskovic, Schaffhausen, both of Switzerland

[73] Assignee: Georg Fischer Disa AG, Switzerland

[21] Appl. No.: 725,126

[22] Filed: Oct. 2, 1996

[30] Foreign Application Priority Data

Oct. 4, 1995 [CH] Switzerland ..... 02798/95

[51] Int. Cl.[6] ..... B22C 5/00

[52] U.S. Cl. ..... 164/5; 241/5; 241/275; 241/DIG. 10

[58] Field of Search ..... 164/5; 241/DIG. 10, 241/5, 275

[56] References Cited

U.S. PATENT DOCUMENTS

| | | | |
|---|---|---|---|
| 1,280,838 | 10/1918 | Rapp | 241/DIG. 10 X |
| 1,611,944 | 12/1926 | Rapp | 241/DIG. 10 X |

FOREIGN PATENT DOCUMENTS

| | | | |
|---|---|---|---|
| 57-22843 | 2/1982 | Japan | 164/5 |
| 4-55038 | 2/1992 | Japan | 164/5 |
| 376760 | 7/1932 | United Kingdom | 241/275 |

*Primary Examiner*—J. Reed Batten, Jr.
*Attorney, Agent, or Firm*—Bachman & LaPointe, P.C.

[57] ABSTRACT

Used foundry sand is divided into two falling streams and the grains of a first falling stream are accelerated and diverted into the second falling stream.

6 Claims, 1 Drawing Sheet

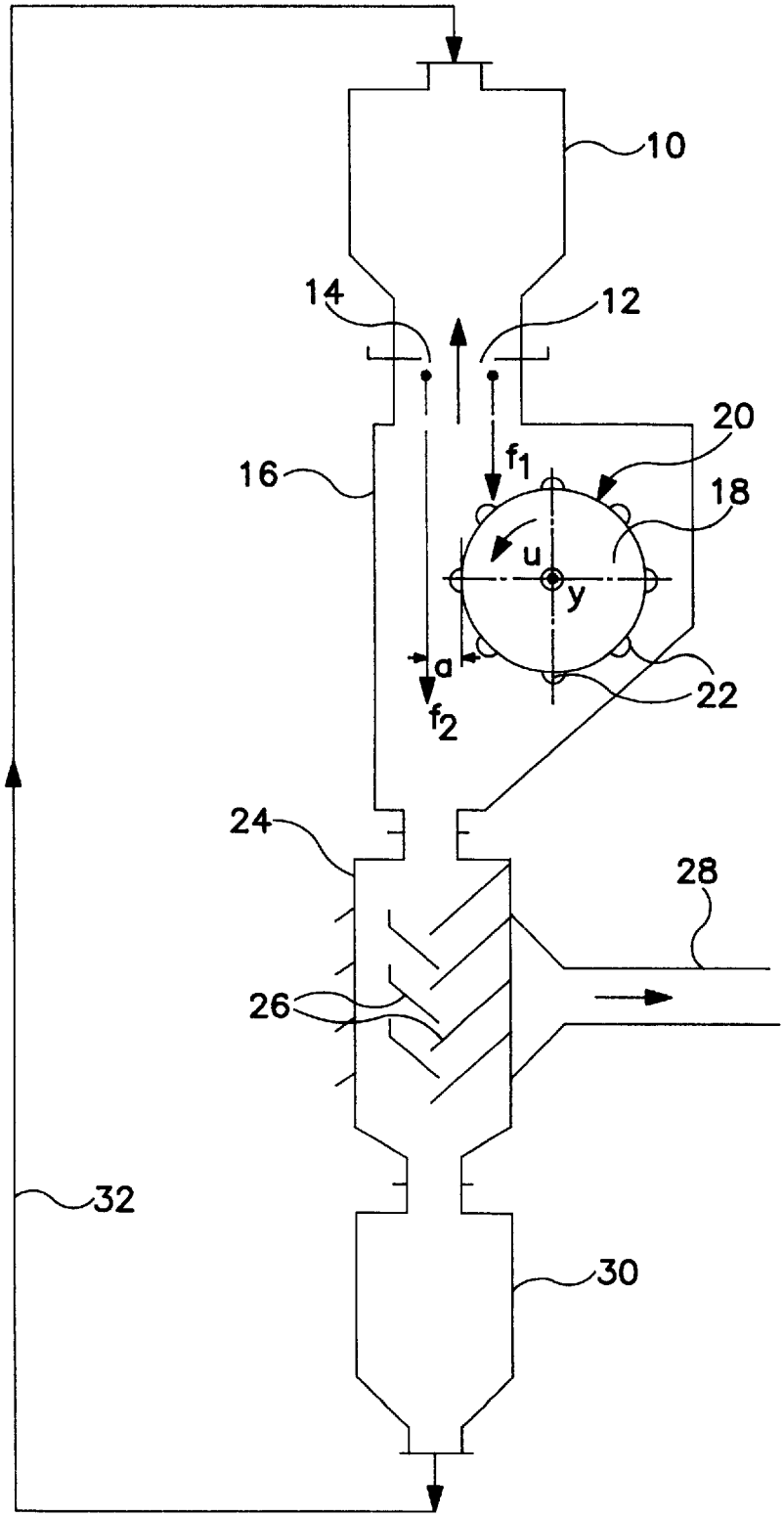
10
14
12
20
16
$f_1$
18
u
y
a
22
$f_2$
24
28
26
32
30

PROCESS FOR RECLAIMING USED FOUNDRY SAND

BACKGROUND OF THE INVENTION

The invention relates to a process for reclaiming used foundry sand with a more or less large fraction of bentonite-bonded sand, the sand grains of the used sand being repeatedly accelerated and decelerated in a treatment chamber, abraded by combined impact and shear stress plus intensive grain-on-grain friction and as a result freed of the useful and dead-burnt binders and additives adhering to the sand grains, dust which is formed during the treatment being separated from the sand. An apparatus which is suitable for carrying out the process is also within the scope of the invention.

The molding sand circuit of a foundry includes the shake-out point. If the molds are made from a bentonite-bonded mold material, a mixed sand with more or less large fractions of bentonite-bonded sand and (various) core sand is obtained at this point. In addition to mineral sands and synthetic resin binders, this mixture also contains additions, such as bentonite, coal dust, etc., which have been partly destroyed by the action of heat and the bentonite has been burnt to form on the grain a hard and porous layer with low refractory qualities. In the absence of reclamation, this mixture is fed back to the mold material preparation and missing additions have to be replaced.

In the reclamation of used sand, the sand grains are freed of the adhering binders and additives. The used sand reclaimed in this way substantially attains the properties of new silica sand and can therefore be reused instead of new sand.

A reclamation process of the type mentioned at the outset is disclosed by DE-A-2,909,408. The treatment chamber is formed by a rotating drum, in the inside of which a rotor which is arranged concentrically with the drum axis and has a large number of axially parallel friction members rotates. Some of the falling stream of sand falls onto this rotor and is subjected to an intensive impact/shear stress as the grains are accelerated.

The known process has the disadvantage that the stream of sand which is to be treated cannot be controlled accurately enough, necessitating a relatively long treatment time.

SUMMARY OF THE INVENTION

Accordingly, it is the principal object of the present invention to provide a process and an apparatus by means of which the throughput capacity can be improved while maintaining the quality of the reclaimed material.

BRIEF DESCRIPTION OF THE DRAWINGS

Further advantages, features and details of the invention emerge from the following description of a preferred exemplary embodiment and with reference to the figure, which diagrammatically depicts a reclamation apparatus for use with the process of the present invention.

DETAILED DESCRIPTION

With respect to the process, the solution according to the invention comprises the sand being divided into two falling streams. The grains of the first stream fall onto a rotor, where they are strongly accelerated and thus, exposed to impact/shear stress, are thrown into the second falling stream, where they are very quickly decelerated by the intensive grain-on-grain friction. Preferably, the falling streams are of different sizes, i.e. the amount of sand falling per unit time differs.

The process according to the invention is particularly suitable for a batchwise treatment of the sand. A batch of sand is circulated until the desired quality of reclaimed material is achieved.

The adhering binders and additions, both still useful and damaged, which are abraded from the grains become dust. This is preferably sucked off continuously. As a result of a time-dependent division of the sucked-off fine fractions, undestroyed fractions can be fed back again into the molding sand circuit proportionately as a product of value (active bentonite and coal dust). As a result, expensive raw materials are saved and the amount of problematic material for landfilling is reduced.

In a particularly preferred embodiment of the process according to the invention, the suction removal is controlled in accordance with the process disclosed by DE C 4,032,798. In this process, the dust is sucked off in a fractionated manner, such that binders and additives are obtained separately from the other dust fractions, in that the fractionated suction removal of the dust is controlled on the basis of particle size differences by means of the suction power and/or a change in the subatmospheric pressure level, and/or is carried out for a predetermined time, whereupon the separated fractions of binders and additives in dust form are fed back into the molding sand circuit.

An apparatus which is particularly suitable for carrying out the process according to the invention is distinguished by the fact that a rotor having friction members projecting from the circumferential surface of the rotor is arranged in the treatment chamber, and the treatment chamber has adjustable inlet orifices for the falling streams of sand. The first inlet orifice guides the falling stream onto the rotor, the second guides the second falling stream downward at a certain distance in front of the rotor.

Expediently, one or more sand containers having the inlet orifices for the corresponding outlet orifices are arranged above the treatment chamber. A dust removal unit having a suction line for suction removal of the fine fractions in a specifically directed manner is arranged beneath the treatment chamber, and beneath is arranged a collection container for reclaimed material.

In order to maintain circuit operation, this collection container is connected to the stock container above the treatment chamber by means of a conveying unit.

The machine can also be constructed as a two-stage machine, in order to increase the cleaning intensity.

The machine for reclaiming used foundry sand has sand stock containers 10 having two outlet orifices 12, 14. The stock container(s) 10 are mounted on a treatment chamber 16, in the inside of which a rotor 18 having friction members 22 projecting from the circumferential surface 20 of the rotor is arranged.

A dust removal unit 24 which is provided with baffles 26 and has a suction line 28 for removing the fine fractions is situated beneath the treatment chamber. A collection container 30 for catching the de-dusted sand adjoins the dust removal unit 24. To complete the sand circuit in the machine, the collection container 30 is connected to the stock container 10 via a conveying unit 32.

The sand which is to be reclaimed is introduced into the stock container 10 in batches, in a well-prepared form, that is, pretreated so as to obtain the following characteristics: no lumps >10mm, free of metal fractions, water content 1% max. The outlet orifices are designed such that a first part stream—depicted in the drawing by the falling line f1—falling through the outlet orifice 12, falls onto the rotor.

The second part stream, flowing through the outlet orifice 14, falls downward along the falling line f2, at a distance a from the circumferential surface 20 of the rotor.

The sizes of the outlet orifices can be adjusted such that the part streams falling out of the outlet orifices 12 and 14 are of different or identical sizes.

Due to the rotary movement of the rotor 18 driven by a suitable motor (not shown) about its horizontal axis y, the sand grains of the first part stream falling onto it from outlet orifice 12 are intercepted by the friction members, accelerated and, as a result, subjected to impact/friction forces. The grains are then thrown at great speed into the part stream falling freely downward from outlet orifice 14 and are very quickly decelerated in the latter by intensive grain-on-grain friction. The adhering binders are thus abraded off and, as an additional effect, any sharp edges on the grains are rounded.

The installation operates in a batchwise manner, i.e., a batch of used sand is circulated until the required quality of reclaimed material is achieved. The reclaimed material is then removed from the installation and a new batch is fed in.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for treating used foundry sand comprising sand grains having binders and additives adhering thereto comprising the steps of:

providing a batch of used foundry sand in a container;

gravity feeding a first and a second substantially parallel streams of used foundry sand from the container;

accelerating and diverting the used foundry sand from the first stream into the second stream wherein the used foundry sand in the first stream impacts the used foundry sand in the second stream and is decelerated whereby adhering binders and additives are abraded off and any sharp edges of the sand grains are rounded.

2. A process for treating used foundry sand wherein the first stream is accelerated and deflected by gravity feeding the first stream onto a rotor means provided with friction members for imparting impact and shear forces.

3. A process for treating used foundry sand according to claim 1 including the step of controlling the sizes of the first and second stream.

4. A process for treating used foundry sand according to claim 1 including the step of separating of fine fractions of the binders and additives abraded off.

5. A process for treating used foundry sand according to claim 4 including the step of recirculating the rounded sand grains to the container.

6. A process for treating used foundry sand according to claim 4 including the step of separating the fine fractions by means of suction to obtain valuable fine fractions which are fed to a molding sand circuit.

* * * * *

UNITED STATES PATENT AND TRADEMARK OFFICE

CERTIFICATE OF CORRECTION

PATENT NO. : 5,836,369

DATED : November 17, 1998

INVENTOR(S) : CHRISTIAN RENNER ET AL.

It is certified that error appears in the above-identified patent and that said Letters Patent is hereby corrected as shown below:

In Column 4, claim 2, line 14, after "sand"
--according to claim 1-- should be inserted.

Signed and Sealed this

Third Day of April, 2001

Nicholas P. Godici

*Attest:*

NICHOLAS P. GODICI

*Attesting Officer*

*Acting Director of the United States Patent and Trademark Office*